US007531110B2

(12) United States Patent
Crandall et al.

(10) Patent No.: US 7,531,110 B2
(45) Date of Patent: May 12, 2009

(54) SOLVENT SYSTEM FOR OVERCOATING MATERIALS

(75) Inventors: Raymond K. Crandall, Rochester, NY (US); John F. Yanus, Webster, NY (US); Ed J. Radigan, Scottsville, NY (US); Michael E. Zak, Canandaigua, NY (US)

(73) Assignee: Xerox Corporation, Norwalk, CT (US)

( * ) Notice: Subject to any disclaimer, the term of this patent is extended or adjusted under 35 U.S.C. 154(b) by 452 days.

(21) Appl. No.: 11/256,930

(22) Filed: Oct. 24, 2005

(65) Prior Publication Data

US 2007/0092824 A1 Apr. 26, 2007

(51) Int. Cl.
*B01F 1/00* (2006.01)

(52) U.S. Cl. ..... 252/364

(58) Field of Classification Search ..... 252/364
See application file for complete search history.

(56) References Cited

U.S. PATENT DOCUMENTS

| | | | | |
|---|---|---|---|---|
| 4,298,697 | A | 11/1981 | Baczek et al. | |
| 4,338,390 | A | 7/1982 | Lu | |
| 4,560,635 | A | 12/1985 | Hoffend et al. | |
| 2001/0056175 | A1 * | 12/2001 | Savariar et al. | 528/381 |

* cited by examiner

*Primary Examiner*—Hoa V Le
(74) *Attorney, Agent, or Firm*—Eugene O. Palazzo; Fay Sharpe LLP

(57) ABSTRACT

A unique solvent system adapted for high speed overcoat applications is disclosed. The solvent system comprises methyl alcohol and monochlorobenzene in a weight ratio of about 6:1 to about 1.5:1, respectively.

4 Claims, 1 Drawing Sheet

SOLVENT SYSTEM FOR OVERCOATING MATERIALS

BACKGROUND

The present disclosure, in various exemplary embodiments, relates to electrophotographic imaging members and, more specifically, to layered photoreceptor structures with improved overcoat layers and processes for making the imaging members. Specifically, the exemplary embodiment relates to a solvent system for coating certain overcoating materials to produce a high quality surface finish.

Electrophotographic imaging members, i.e. photoreceptors, typically include a photoconductive layer formed on an electrically conductive substrate. The photoconductive layer is an insulator in the dark so that electric charges can be retained on its surface. Upon exposure to light, the charge is dissipated.

An electrostatic latent image is formed on the photoreceptor by first uniformly depositing an electric charge over the surface of the photoconductive layer by one of the many known means in the art. The photoconductive layer functions as a charge storage capacitor with charge on its free surface and an equal charge of opposite polarity on the conductive substrate. A light image is then projected onto the photoconductive layer. The portions of the layer that are not exposed to light retain their surface charge. After development of the latent image with toner particles to form a toner image, the toner image is usually transferred to a receiving substrate, such as paper.

Imaging members can have a number of different configurations. For example, they can comprise a flexible member, such as a flexible scroll or a belt containing a flexible substrate support. The flexible member belt may be seamed or unseamed. The electrostatographic imaging members can also be a rigid member, such as those utilizing a rigid support substrate drum. Drum imaging members have a rigid cylindrical supporting substrate bearing one or more imaging layers. The use of such small diameter drums or flexible imaging belts places a premium on photoreceptor life. Accordingly, a need exists for improving photoreceptor life.

One approach to achieving longer photoreceptor life is to form a protective overcoat on the imaging surface, e.g. the charge transporting layer of a photoreceptor. This overcoat layer must satisfy many requirements, including transporting holes, resisting image deletion, resisting wear and avoidance of perturbation of underlying layers during coating. Although various hole transporting small molecules can be used in overcoating layers, one of the toughest known overcoatings includes cross-linked polyamide (e.g. LUCKAMIDE) containing N,N'-diphenyl-N,N'-bis(3-hydroxyphenyl)-[1,1'-biphenyl]-4,4'-diamine (DHTBD). This overcoat is described in U.S. Pat. No. 5,368,967, the entire disclosure thereof being incorporated herein by reference.

Known overcoat solutions used on drums or flexible imaging belts are generally not easily coated on web photoreceptors at speeds over one meter per minute (m/min). If higher coating speeds are used, the resulting coatings exhibit a dull and opaque surface quality, even for very thin layers. This problem is exacerbated in a standard alcohol solvent system by dilution to lower percent solids. Accordingly, a need exists for a strategy for coating overcoating materials, and which is particularly adapted for use in high speed coating operations.

BRIEF DESCRIPTION

The present disclosure relates, in various embodiments thereof, to a solvent system particularly adapted for depositing overcoat layers in a high speed coating operation. The solvent system comprises methyl alcohol and monochlorobenzene in a weight ratio of from about 6:1 to about 1.5:1, respectively.

In another aspect, the present disclosure relates, in various embodiments thereof, to a method for producing a photoreceptor having a protective overcoat. The method comprises providing a photoreceptor having an exposed receiving surface. The method also comprises providing an overcoat composition. The method additionally comprises providing a solvent system including methyl alcohol and monochlorobenzene. The method further comprises dispersing the overcoat composition in the solvent system to produce an overcoat layer precursor. And, the method comprises applying the overcoat layer precursor on the receiving surface of the photoreceptor.

These and other non-limiting features or characteristics of the disclosure are more particularly disclosed below.

BRIEF DESCRIPTION OF THE DRAWINGS

The following is a brief description of the drawings, which is presented for the purposes of illustrating the disclosures set forth herein and not for the purpose of lifting the same.

DETAILED DESCRIPTION

Figure 1:
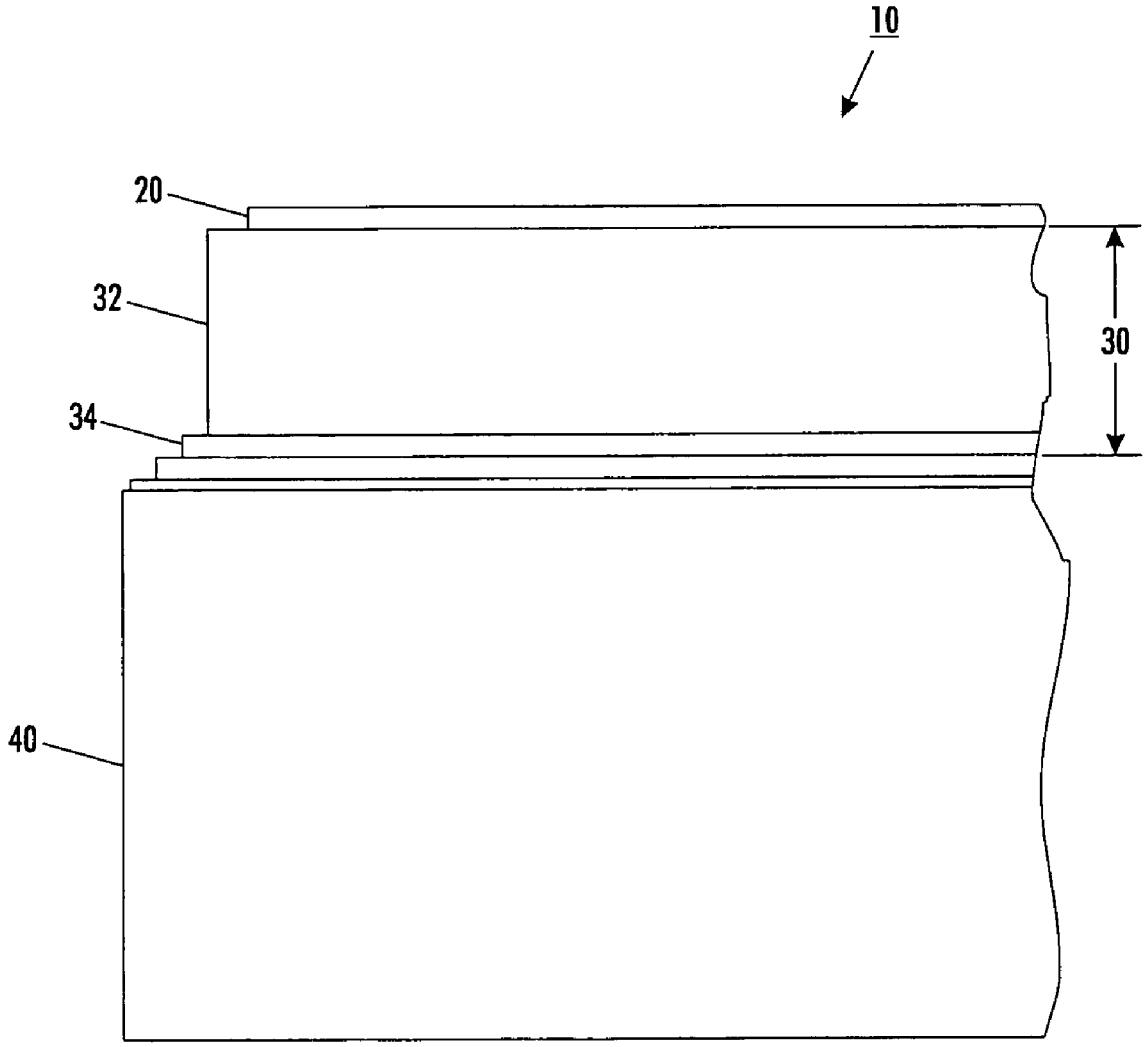
FIG. 1 is a schematic illustration of an exemplary embodiment photoreceptor including an overcoat layer initially comprising an exemplary embodiment solvent system.

The exemplary embodiment enables high speed coating operations by utilizing certain overcoating materials, and in particular, by using a unique solvent system for the overcoat material. The solvent system utilizes a relatively low volatility solvent component, monochlorobenzene, which takes longer to flash evaporate and thereby gives the solutes in the resulting overcoat layer better opportunity to form a solid layer of good clarity and surface finish.

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697; and, 4,338,390, the disclosures of which are totally incorporated herein by reference, subsequently transferring the image to a suitable substrate, and permanently affixing the image thereto.

A more complete understanding of the processes and apparatuses disclosed herein can be obtained by reference to the accompanying drawing. This figure is merely a schematic representation based on convenience and the ease of demonstrating the present development, and is, therefore, not intended to indicate relative size and dimensions of an imaging device or components thereof.

FIG. 1 schematically illustrates an exemplary embodiment photoreceptor 10 including an overcoat layer 20 disposed on a photoconductive layer 30, which is disposed on an electrically conductive substrate 40 or other member. The overcoat layer 20 is applied to the photoconductive layer 30 by dispersing the overcoat solids or overcoat composition, in the exemplary embodiment solvent system described herein at a solids concentration of from about 4% by weight to about 12% by weight, and typically at a solids concentration of about 8% by weight.

The substrate 40 may be opaque or substantially transparent and may comprise any suitable material having the required mechanical properties. Accordingly, the substrate may comprise a layer of an electrically non-conductive or conductive material such as an inorganic or an organic composition. Various resins may be employed as non-conductive materials including polyesters, polycarbonates, polyamides, polyurethanes, and the like, which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength and desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness, e.g., less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be from about 20 angstroms to about 750 angstroms, and more preferably from about 100 angstroms to about 200 angstroms for an optimum combination of electrical conductivity, flexibility, and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer may be utilized and such adhesive layer materials are well known in the art. Typical adhesive layer materials include, for example, polyesters, polyurethanes, and the like. Satisfactory results may be achieved with adhesive layer thickness from about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying, and the like.

At least one electrophotographic imaging layer 30 is formed on the adhesive layer, blocking layer, or substrate. The electrophotographic imaging layer may be a single layer that performs both charge generating and charge transport functions, as is well known in the art, or it may comprise multiple layers such as a charge generator layer 34 and charge transport layer 32. Charge generator (also referred to as photogenerating) layers may comprise amorphous films of selenium and alloys of selenium and arsenic, tellurium, germanium and the like, hydrogenated amorphous silicon and compounds of silicon and germanium, carbon, oxygen, nitrogen, and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakisazos; and the like dispersed in a film forming polymeric binder and fabricated by solvent coating techniques. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene bisimide pigments; indigo pigments such as indigo, thioindigo, and the like; bisbenzoimidazole pigments such as Indofast Orange toner, and the like; phthalocyanine pigments such as titanyl phthalocyanine, aluminochlorophthalocyanine, hydroxygalliumphthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the disclosure and include for instance selenium-arsenic, selenium-tellurium-arsenic, and selenium-tellurium.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal-free phthalocyanine. The phthalocyanines exist in many crystal forms, which have a strong influence on photo-generation.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrenealkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder. In embodiments, preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing the solvent of a solvent coated layer may be effected by any suitable conventional technique such as oven drying, infrared radiation drying, air drying and the like.

In fabricating a photosensitive imaging member, a charge generating material (CGM) or pigment, herein the terms "pigment" and "charge generating material" are used interchangeably, and a charge transport material (CTM) may be deposited onto the substrate surface either in a laminate type configuration where the CGM and CTM are in different layers or in a single layer configuration where the CGM and CTM are in the same layer along with a binder resin. A photoreceptor can be prepared by applying over the electrically conductive layer the charge generation layers and a charge transport layer. In embodiments, the charge generating layer and the charge transport layer may be applied in any order.

In embodiments, the charge generating layer adjacent to the charge transporting layer is partially trapping to charge generated in the other charge generating layer(s) which are passing through this layer to the charge transporting layer. Normally, the above photoexcited charges are holes so the generation layer adjacent to the transport layer must be partially trapping to holes transiting through it, but if the transport layer transports electrons it would be electron trapping. This functionality can be in the pigment itself, that is, the pigment may be a good electron transporter but a poor hole transporter. Such pigments are sometimes referred to as extrinsic pigments because they require the presence of hole transport, i.e., electron donor, molecules. Examples of extrinsic electron transporting pigments are perylene and azo pigments and their derivatives. The degree of hole trapping can be controlled by introducing hole transport molecules either directly or by diffusion from the charge transport layer. Examples of charge transport materials are listed below. Alternatively or in combination, additives can be used to increase the charge trapping. Thus in case of ambipolar, also referred to as intrinsic, pigments such as phthalocyanines, trapping additives in combination with charge transport molecules can be added. Suitable additives are other charge transport materials whose energy levels are 0.2 eV different from the primary charge transport molecule.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(-vinyltetraphene); poly(vinyltetracene) and poly(vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone, biphenylquinone derivatives and phenylquinone derivatives.

Any suitable inactive resin binder with the desired mechanical properties may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layers. Typical application techniques include spraying, dip coating, roll coating, wire wound rod coating, vacuum coating, and the like. Drying of the deposited coating may be effected by any suitable conventional technique such as oven drying, infrared radiation drying, air drying and the like. Generally, the thickness of each charge generating layer ranges from about 0.1 micrometer to about 3 micrometers and the thickness of the transport layer is from about 5 micrometers to about 100 micrometers, but thicknesses outside these ranges can also be used. The thickness of the charge generating layer adjacent to the charge transport layer is selected so that the required fraction of the charge is trapped resulting in the desired voltage. The desired thickness is then governed by the fraction of charge transiting the charge generating layer adjacent to the charge transport layer. In general, the ratio of the thickness of the charge transport layer to the charge generating layer is preferably maintained from about 2:1 to 200:1 and in some instances as great as 400:1.

An overcoat 20 may include any suitable overcoat material which may be applied by employing a low volatility solvent system in accordance with the present disclosure. In one aspect of the exemplary embodiment, a currently known solvent system is modified such that the resulting solvent system has a lower volatility. A standard solvent formulation is 45.5% by weight methyl alcohol (MeOH), 45.4% by weight n-propanol (1-propanol) and 9.2% by weight tetrahydrofuran (THF). In accordance with the exemplary embodiment, monochlorobenzene (MCB) is added in a proportion of 25%, by weight as a solvent component. The normal propanol is removed and methyl alcohol remains as the other component, at 75% by weight in the solvent. Tetrahydrofuran can optionally be added so that it constitutes from about 15% to about 5%, and particularly about 10% by weight of the resulting solvent system. This formulation can be combined with an overcoat material so as, for example, to contain 16% by weight total solids in solution. Prior to application, the coating composition can be further diluted to about 8.0% by weight total solids. In a trial in accordance with the exemplary embodiment, an 8.0% by weight overcoat composition dispersed in the exemplary embodiment solvent system provided good quality coatings of photoreceptor material on a Dilts Coater at web speeds up to about 12.2 m/min (40 feet/min). At increased web speeds there was still some haze and cloudiness of the overcoat layer, but the quality was considered to not be detrimental to the xerographic process.

The exemplary embodiment overcoat solvent system comprises methyl alcohol (MeOH) and monocholorobenzene (MCB) in a weight ratio (MeOH:MCB) of from about 6:1 to about 1.5:1, and more particularly from about 5:1 to about 4:1. And in certain applications, the weight ratio of these components can be about 3:1, respectively.

The exemplary embodiment includes solvent systems in which all or a portion of the monochlorobenzene is replaced with one or more of an equivalent solvent having a similar flashpoint or volatility. More particularly, the exemplary embodiment includes solvent systems in which all or a portion of the monochlorobenzene is replaced with such equivalent solvent(s). Generally, from about 10% to about 90% of the monochlorobenzene is replaced with one or more of the selected equivalent solvents.

The exemplary embodiment system also includes solvent systems as described herein in which all or a portion of the methyl alcohol is replaced with a comparable solvent. The portion of methyl alcohol replaced with one or more comparable solvents can range from about 10% to about 90%, and more particularly, from about 25% to about 75%.

The exemplary embodiment solvent system can be used with a variety of overcoat formulations. For example, the overcoat formulation can be a self-condensation of LUCKAMIDE, or a cross-linking agent, such as hexamethoxymethylmelamine (commercial name CYMEL 303) plus LUCKAMIDE or ELVAMIDE (the latter two materials being alcohol soluble nylon polyamides).

Overcoat compositions that include the exemplary embodiment solvent systems described herein can form coatings having thicknesses from about 0.1 microns to about 8 microns, and more particularly from about 1 micron to about 4 microns.

The exemplary embodiment also provides a method for depositing or otherwise forming an overcoat layer on a photoreceptor, and specifically, on a photoconductive layer of such a photoreceptor. The exemplary embodiment can include preparing an overcoat coating solution by dispersing an appropriate overcoat composition in the exemplary embodiment solvent system such that the weight percent solids is from about 4% to about 12%, and particularly about 8%. The resulting overcoat coating solution serves as a precursor for depositing or otherwise forming an overcoat layer, such as on a photoreceptor. The resulting overcoat coating solution is then applied onto a receiving surface, such as an exposed surface of a photoconductive layer 30, such as depicted in FIG. 1. After deposition of the overcoating formulation, the overcoat coating solution is dried by removing at least substantially all of the solvent system. Removal can be performed by evaporation of the solvent system. Evaporation can be in the form of flash evaporation. Removal is performed to thereby produce an overcoat layer, such as layer 20 in FIG. 1.

The exemplary embodiment also provides an imaging member such as a photoreceptor having an overcoat formed using the solvent system described herein.

The exemplary embodiment is based upon the discovery that the replacement of n-propanol by monochlorobenzene in a standard overcoat formulation enables good quality overcoat films of targeted thicknesses from less than 1 micron to at least 4 or more microns dry film thickness on photoreceptor materials, coated under high speed manufacturing process conditions.

Any suitable and conventional technique may be utilized to mix and thereafter apply the overcoat layer coating mixture to the photoreceptor assembly. Typical application techniques include spraying, dip coating, roll coating, wire wound rod coating, and the like. Drying of the deposited coating may be effected by any suitable conventional technique such as oven drying, infrared radiation drying, air drying and the like.

Any suitable drying system may be utilized for drying the coatings. A forced air oven is preferred because of rapid drying and safety concerns. Preferably, drying is effected by impingement of air streams directed against the exposed surface of the overcoating layer. Optimum results are achieved—when the paths of the air streams are substantially perpendicular to the coated surface. For drums, the air stream paths are perpendicular to an imaginary tangent to the curved surface of the drum and perpendicular to the imaginary axis of the drum. Preferably, the air streams have a velocity of from about 1 cm per second to about 100 cm per second. The air stream velocity should be maintained at a velocity below that which would distort the deposited undried charge transport layer coating and undried overcoat layer coating. Preferably, the drying of the combination of undried transport layer coating and undried overcoat layer coating is a ramped function in which the final temperature of drying is typically arrived at, for example, after about 25 minutes. Alternatively, drying can be accomplished in multiple steps such as, for example, a lower temperature (e.g., from about 80° C. and 90° C. for about 25 minutes) followed by a final temperature (e.g., from about 110° C. and about 120° C. for 30 minutes). This allows the transport layer solvent to escape before the overcoat layer dries or cross links to form a barrier to solvent migration from the charge transport layer. When a cross linkable polyamide is employed in the overcoat layer, the polyamide crosslinks and is insoluble in alcohol by about the time drying and curing is completed. Such cross linked polymer is a barrier to solvent migration from the transport layer.

The photoreceptor of the exemplary embodiment may be used in any conventional electrophotographic imaging system such as copiers, duplicators, printers, facsimile and multifunctional systems. As described herein, electrophotographic imaging usually involves depositing a uniform electrostatic charge on the photoreceptor, exposing the photoreceptor to a light image pattern to form an electrostatic latent image on the photoreceptor, developing the electrostatic latent image with electrostatically attractable marking particles to form a visible toner image, transferring the toner image to a receiving member and repeating the depositing, exposing, developing and transferring steps at least once.

The development of the present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLE 1

16.6 grams of ELVAMIDE 8063 (available from DuPont) and 94.4 grams of LUCKAMIDE (available from Dai Nippon) were placed in a 2.5-liter bottle with 500 grams of methanol and allowed to set overnight. The swollen mixture was heated with stirring in a water bath at 60-65° C. for one hour to effect a complete solution. The 2.5-liter bottle was removed from the water bath and to the stirred solution was added 500 grams of n-propanol, 88.8 grams of N,N'-diphenyl-N,N'-bis(3-hydroxyphenyl)-[1,1'-biphenyl]-4,4'-diamine (DHTBD), and 8.9 grams oxalic acid. This mixture was called solution A.

8.9 grams CYMEL 303 (available from Cytec Industries), 22.2 grams of Tris TPM, and 88.8 grams of tetrahydrofuran (THF) were placed in a 4-ounce bottle. This mixture was called solution B and was colorless.

Solution B was added to the 2.5-liter bottle containing solution A and stirred for 30 minutes. The final solution was found to consist of 18.1% solids by weight of the solution and contained 6.7% THF.

EXAMPLE 2

7.5 grams of ELVAMIDE 8063 and 42.5 grams of LUCKAMIDE were placed in a 1.0-liter bottle with 425 grams of methanol and allowed to set overnight. The swollen mixture was heated with stirring in a water bath at 60-65° C. for one hour to effect a complete solution. The 1.0-liter bottle was removed from the water bath and to the stirred solution was added 40 grams of DHTBD and 4 grams oxalic acid. This mixture was called solution A.

4 grams CYMEL 303, 10 grams of bis-[2-methyl-4-{N,N-ethyl-amino}phenyl]-[4-N,N-ethyl-aminophenyl]methane [Tris TPM], and 125 grams of monochlorobenzene were placed in an 8-ounce bottle. This mixture was called solution B and was colorless.

Solution B was added to the 1.0-liter bottle containing solution A and stirred for 30 minutes. The final solution was found to consist of 16.4% solids by weight of the solution and contained 19.2% monochlorobenzene.

EXAMPLE 3

7.5 grams of ELVAMIDE 8063 and 42.5 grams of LUCKAMIDE were placed in a 1.0-liter bottle with 390 grams of methanol and allowed to set overnight. The swollen mixture was heated with stirring in a water bath at 60-65° C. for one hour to effect a complete solution. Separately, a p-toluenesulfonic acid/pyridine complex solution was prepared by dissolving 10 grams of p-toluenesulfonic acid and 5 grams pyridine in 85 grams of methanol. The 1.0-liter bottle was removed from the water bath and to the stirred solution was added 40 grams of DHTBD, 4 grams CYMEL 303, 125 grams monochlorobenzene, and 10 grams of the p-toluenesulfonic acid/pyridine complex solution. The final solution was found to consist of 15.3% solids by weight of the solution and contained 20.1% monochlorobenzene.

EXAMPLE 4

7.5 grams of ELVAMIDE 8063 and 42.5 grams of LUCKAMIDE were placed in a 1.0-liter bottle with 400 grams of methanol and allowed to set overnight. The swollen mixture was heated with stirring in a water bath at 60-65° C. for one hour to effect a complete solution. The 1.0-liter bottle was removed from the water bath and to the stirred solution was added 40 grams of DHTBD, 4 grams CYMEL 303, 125 grams monochlorobenzene, and 4 grams oxalic acid. The final solution was found to consist of 15.7% solids by weight of the solution and contained 20.1% monochlorobenzene.

COATING PROCESS EXAMPLE

The coating solution is delivered under nitrogen gas pressure of 2 PSI to a Zenith metering pump with a nominal volume of 2.7 cc per revolution and from there into the coating die. The coating die has a 433 mm-wide coating zone with a 0.003 inch (3 mil) slot width and die to web gap from 4 to 10 mils. The wet laydown of the layer is accomplished when the web is vertical and has a steep take off angle into the overhead dryer. The web speed is up to 40 feet per minute (fpm). The wet layer thickness is from a minimum of 6 microns up to a maximum of 50 microns. Drying conditions vary from an initial temperature of 160° F. up to 250° F.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A solvent system particularly adapted for depositing overcoat layers in a high speed coating operation, the solvent system comprising:

methyl alcohol (MeOH) and monochlorobenzene (MCB) in a MeOH:MCB weight ratio of from about 6:1 to about 1.5:1; and, from about 5% to about 15% by weight of tetrahydrofuran.

2. The solvent system of claim 1, wherein the MeOH:MCB weight ratio is from about 5:1 to about 4:1.

3. The solvent system of claim 1, wherein the MeOH:MCB weight ratio is about 3:1.

4. The solvent system of claim 1, wherein the system comprises about 10% tetrahydrofuran.

* * * * *